US006045087A

United States Patent [19]

Vislocky et al.

[11] Patent Number: 6,045,087

[45] Date of Patent: Apr. 4, 2000

[54] SPOOL ASSEMBLY FOR SNAP FIT OF FLANGES AND SPINDLE HAVING GUIDING MEMBERS FOR ALIGNING WITH THE FLANGES SPINDLE

[76] Inventors: Mark Vislocky, 1122 Thirza Plz.; Curtis Walters, 1121 Madison Hill Rd., both of Rahway, N.J. 07065

[21] Appl. No.: 08/702,973

[22] Filed: Aug. 26, 1996

[51] Int. Cl.[7] ..... B65H 75/14

[52] U.S. Cl. ..... 242/608.6; 242/608.2; 242/609.1

[58] Field of Search ..... 242/608.6, 608.2, 242/609.1, 118.61

[56] References Cited

U.S. PATENT DOCUMENTS

| | | | |
|---|---|---|---|
| 1,950,738 | 3/1934 | Mills | 242/608.6 X |
| 2,267,126 | 12/1941 | Moretti | 242/118.61 |
| 2,679,988 | 6/1954 | Morgan | 242/118.61 |
| 3,041,005 | 6/1962 | Wallace | 242/609.1 |
| 3,176,932 | 4/1965 | Kovaleski | 242/609.1 X |
| 3,533,571 | 10/1970 | Turner et al. | 242/608.2 X |
| 3,552,677 | 1/1971 | Hacker | 242/118.61 |
| 3,661,341 | 5/1972 | Eifrid | 242/608.2 X |
| 3,785,584 | 1/1974 | Crellin | 403/381 X |
| 3,822,841 | 7/1974 | Campbell . | |
| 3,905,561 | 9/1975 | Kelch et al. | 242/609.1 |
| 4,671,409 | 6/1987 | Espy . | |
| 4,903,913 | 2/1990 | McCaffrey . | |
| 5,143,316 | 9/1992 | Goetz et al. . | |
| 5,335,873 | 8/1994 | Harris et al. . | |
| 5,575,437 | 11/1996 | Campbell | 242/608.6 |

FOREIGN PATENT DOCUMENTS

| | | | |
|---|---|---|---|
| 2691448 | 11/1993 | France | 242/608.6 |
| 464623 | 12/1968 | Switzerland | 242/118.61 |
| 851200 | 10/1960 | United Kingdom | 242/608.2 |
| 9413570 | 6/1994 | WIPO . | |

*Primary Examiner*—Daniel P. Stodola
*Assistant Examiner*—Gregory J. Strimbu
*Attorney, Agent, or Firm*—Lerner, David, Littenberg, Krumholz & Mentlik, LLP

[57] ABSTRACT

A spool assembly comprises a spindle formed as a tubular section having an inner surface and two end faces. A guiding notch is furnished in each end face of the spindle. A locking opening is furnished near each end of the spindle. The spool assembly further comprises two flanges. Each flange includes a disk and a hub. Each hub is centeredly and fixedly attached to each disk and has a tubular shape such that an outer face of each hub matches the inner surface of the spindle. A guiding member protrudes outwardly from each hub for engaging a respective one of the guiding notches to rotate the spindle relative to each hub into a proper aligned position with respect to each hub as the spool assembly is assembled. A locking member is provided on each hub for engaging a respective one of the locking openings such that, upon insertion of each hub into a respective end of the spindle, a connection between the hubs and the spindle is obtained which is stable against pulling forces in an axial direction.

21 Claims, 12 Drawing Sheets

SPOOL ASSEMBLY FOR SNAP FIT OF FLANGES AND SPINDLE HAVING GUIDING MEMBERS FOR ALIGNING WITH THE FLANGES SPINDLE

BACKGROUND OF THE INVENTION

1. Field of the Invention

The present invention relates to a spool assembly, which is lockingly assembled from two flanges and a tube or spindle.

2. Brief Description of the Background of the Invention Including Prior Art

A knock-down spool assembly is taught in U.S. Pat. No. 4,903,913 to McCaffrey. A spindle body has specifically configured end projections and a pair of end plates is furnished to receive the end projections.

A spool assembly is taught in U.S. Pat. No. 5,143,316 to Goetz et al. Each end of a spindle is formed with a resilient locking arrangement and each end plate is formed with a centrally located opening. A locking arrangement is formed on the periphery of each opening to cooperate with a resilient locking arrangement on an end of the spindle.

Campbell in U.S. Pat. No. 3,822,841 teaches a knock-down reel. The knockdown reel comprises a tubular hub and has a pair of similar end flanges disconnectably attached to opposite ends of the hub with a latching means. The latching means can become released to separate the end flanges from the hub and minimize the space consumed in transport and storage.

Espy in U.S. Pat. No. 4,671,409 teaches a disposable light-tight canister. The canister includes an open ended opaque tubular sleeve closed at both ends by opaque end caps lockingly interconnected by a rigid tie bar extending longitudinally between the end caps along a core of the photosensitive media. Resilient fingers are provided at an end of the tie bar for forming a pressure engagement with a central receiving aperture formed in the end cap.

The PCT application with Application number PCT/EP93/03404 and international publication number WO 94/13570 teaches a bobbin for receiving elongated winding material. The bobbin has a winding core upon which are arranged two flanges and where at least one flange is removable. The flange is locked to the winding core for ensuring a stable connection between flange and winding core.

Harris et al. in U.S. Pat. No. 5,335,873 teaches a cassette for web material. The web is wound onto a tubular web core. Hub members have at least one flexible lock at the free end of the hub member and when the flexible lock rotatably engages core grooves, separation of the end caps from the jacket is prevented.

The French printed patent document FR 2,691,448-A1 to Filthaut KG teaches a bobbin made of a synthetic material. Removable projecting disk sections are disposed at the ends of the tubular core, wherein the tubular core is held by radial projections within recesses. The disk units are locked with respect to the core. The bobbin of the French printed patent document FR 2,691,448-A1 is a know-down 5-component assembly, is described to be capable of assembly and disassembly for the purpose of reuse, and is designed for winding ribbons or yarns, etc.

SUMMARY OF THE INVENTION

1. Purposes of the Invention

It is an object of the present invention to provide a spool assembly which can be easily manufactured and which securely locks two flanges to a tubular section.

It is another purpose of the present invention to provide for a spool assembly which can be easily shipped in quantity while requiring a low volume of space.

It is yet a further purpose of the present invention to provide for a spool assembly, which can be easily mounted together to form a stable structure without the use of tools or adhesives.

These and other objects and advantages of the present invention will become evident from the description which follows.

2. Brief Description of the Invention

The present invention provides for a spool assembly. A spindle is furnished by a tubular section having an inner face and having a first end with a first end face and having a second end with a second end face. A first guiding notch is furnished in the first end face of the spindle. A second guiding notch is furnished in the second end face of the spindle. A first locking means is furnished near the first end of the spindle. A second locking means is furnished near the second end of the spindle. A first flange comprises a first disk. A first hub is centeredly attached to the first disk and has a tubular shape such that an outer face of the first hub matches the inner face of the spindle. A first guiding member protrudes on an outside of the first hub for engaging the first guiding notch. A first locking member on the first hub engages the first locking means such that upon insertion of the first hub into the first end of the spindle a connection between the first hub and the spindle is generated which is stable against pulling forces in axial direction and against torsional forces. A second flange comprises a second disk. A second hub is centeredly attached to the second disk and has a tubular shape such that an outer face of the second hub matches the inner face of the spindle. A second guiding member protrudes on an outside of the second hub for engaging the second guiding notch. A second locking member on the second hub engages the second locking means such that upon insertion of the second hub into the second end of the spindle a connection between the second hub and the spindle is generated which is stable against pulling forces in axial direction and against torsional forces.

The spindle can be hollow.

The first guiding notch and the second guiding notch can be recessed into a wall of the spindle and formed as an open slot.

The first locking means and the second locking means can exhibit a substantially rectangular shape.

The shape of the first guiding member can substantially match the shape of the first guiding notch and the shape of the second guiding member can substantially match the shape of the second guiding notch.

First gussets can be disposed between the first hub and the first flange for strengthening the stability of the spool assembly. Second gussets can be disposed between the second hub and the second flange for strengthening the stability of the spool assembly.

A first central borehole can be disposed in the first flange for allowing placement of the first flange on a bearer axis for supporting the first flange, and a second central borehole can be disposed in the second flange for allowing placement of the second flange on the bearer axis for supporting the second flange.

A first reinforcement collar can surround the first central borehole, and a second reinforcement collar can surround the second central borehole.

The spindle can be formed from a piece of tubular stock.

The first locking means can be a first locking opening furnished near the first end of the spindle, and the second locking means can be a second locking opening furnished near the second end of the spindle. The first locking member can protrude on the outside of the first hub for engaging the first locking opening, and the second locking member can protrude on the outside of the second hub for engaging the second locking opening.

The first locking member can be shaped like a first nose on the first hub for engaging the first locking opening with a first tip of the first nose disposed toward the first flange. The second locking member can be shaped like a second nose on the second hub for engaging the second locking opening with a second tip of the second nose disposed toward the second flange.

The first locking means can be furnished as a first protrusion on the inner face of the spindle near the first end of the spindle, and the second locking means can be furnished as a second protrusion on the inner face of the spindle near the first end of the spindle. The first locking member can be an opening in the first hub for engaging the first protrusion, and the second locking member can be an opening in the second hub for engaging the second protrusion.

Alternatively, the first locking means can be a first locking opening furnished near the first end of the spindle. The second locking means can be furnished as a second protrusion on an inner side of the spindle near the first end of the spindle. The first locking member can protrude on the outside of the first hub for engaging the first locking opening. The second locking member can be an opening in the second hub for engaging the second protrusion.

A first inner disk area of the first flange can be more than 10 percent thicker as compared to a thickness of a first outer ring of the first flange. A second inner disk area of the second flange can be more than 10 percent thicker as compared to a thickness of a second outer ring of the second flange. A periphery of the first flange can be furnished with a first collar, and a periphery of the second flange can be furnished with a second collar.

The present invention provides for a 3-component plastic reel or spool assembly comprised of two flange ends and one center core tube or spindle. The invention spool assembly is designed for a secure and permanent one-way snap together attachment without the use of any tools, adhesives, or other processes. The invention spool assembly is designed to receive and wind heavier materials, such as wire and cable, based on its construction, which combines snap undercuts or locking members on the hub of the flange, where the locking members engage corresponding slots or locking openings in a tube or spindle, and primary guide locators and torque transmitters or guiding members.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

In the accompanying drawings, in which are shown several of the various possible embodiments of the present invention.

DESCRIPTION OF INVENTION AND PREFERRED EMBODIMENT

Figure 1:
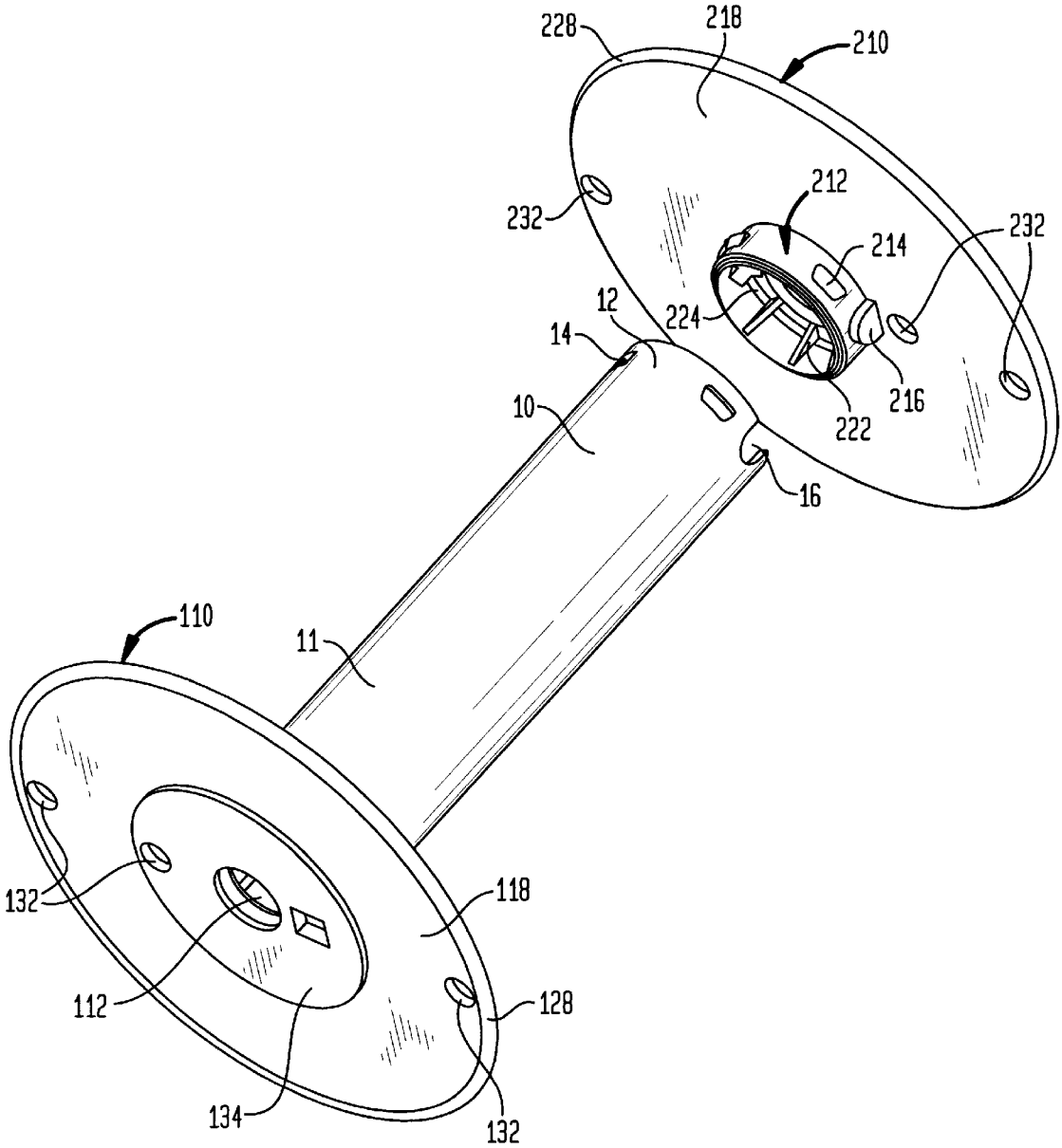
FIG. 1 is a perspective and in part exploded view of the spool assembly of the present invention including a spindle and two flanges.

FIG. 1 provides an overall view of a spindle 10, a first flange 110 and a second flange 210. The flanges 110, 210 have attached hub sections 112 and 212. The spindle 10 can engage with a first end 11 (FIG. 2) the flange 110 and with a second end 12 the second flange 210.

Figure 2:
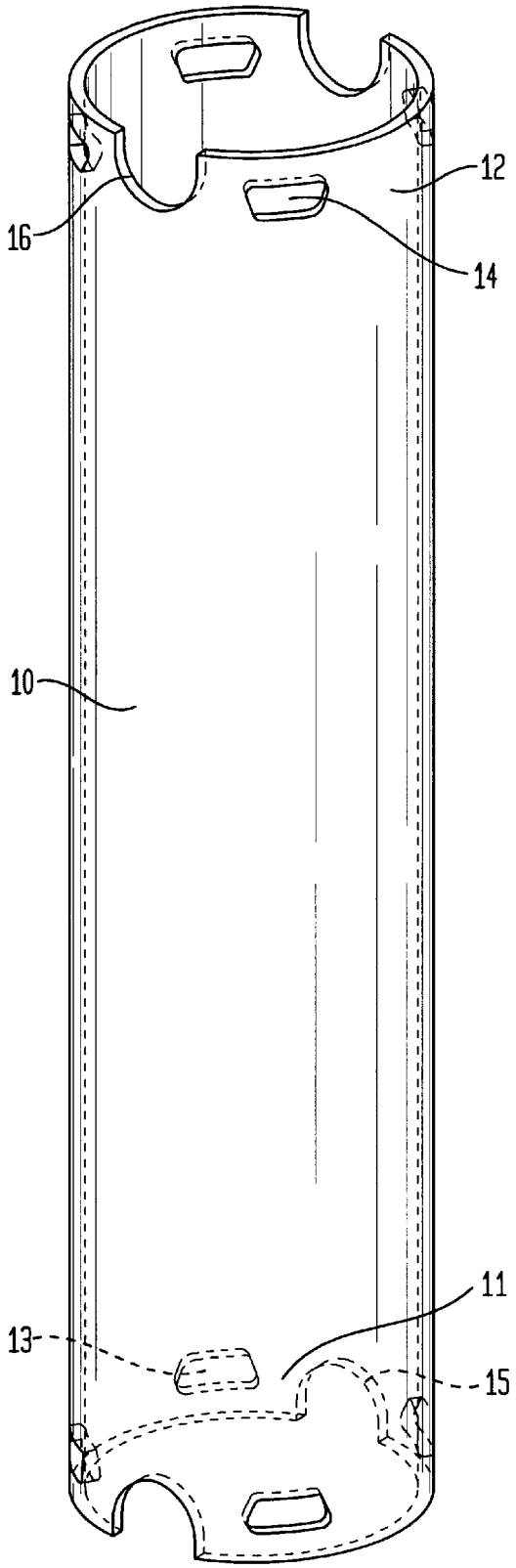
FIG. 2 is an isometric view of the spindle of the present invention.
Figure 3:
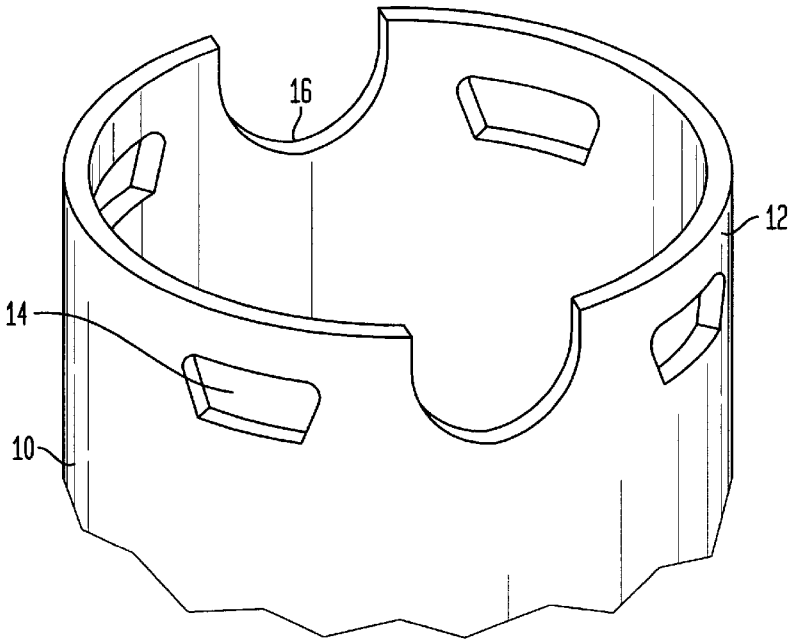
FIG. 3 is a partial and enlarged perspective view of the spindle of the present invention.
Figure 4:
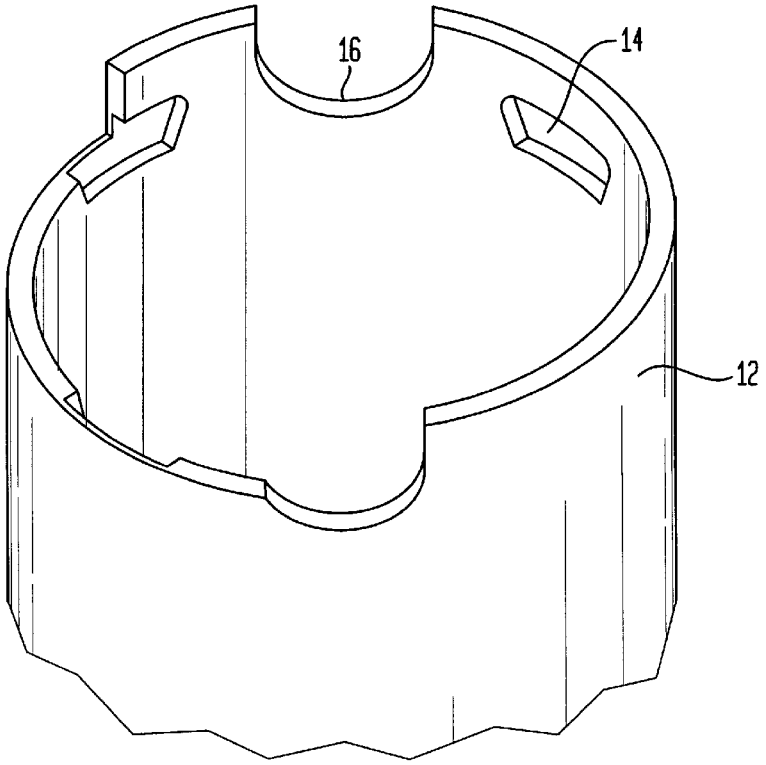
FIG. 4 is an enlarged and partially sectional view of the spindle of the present invention, wherein the section is along a spiral plane starting at an end of the spindle and extending to the area of a recess.
Figure 5:
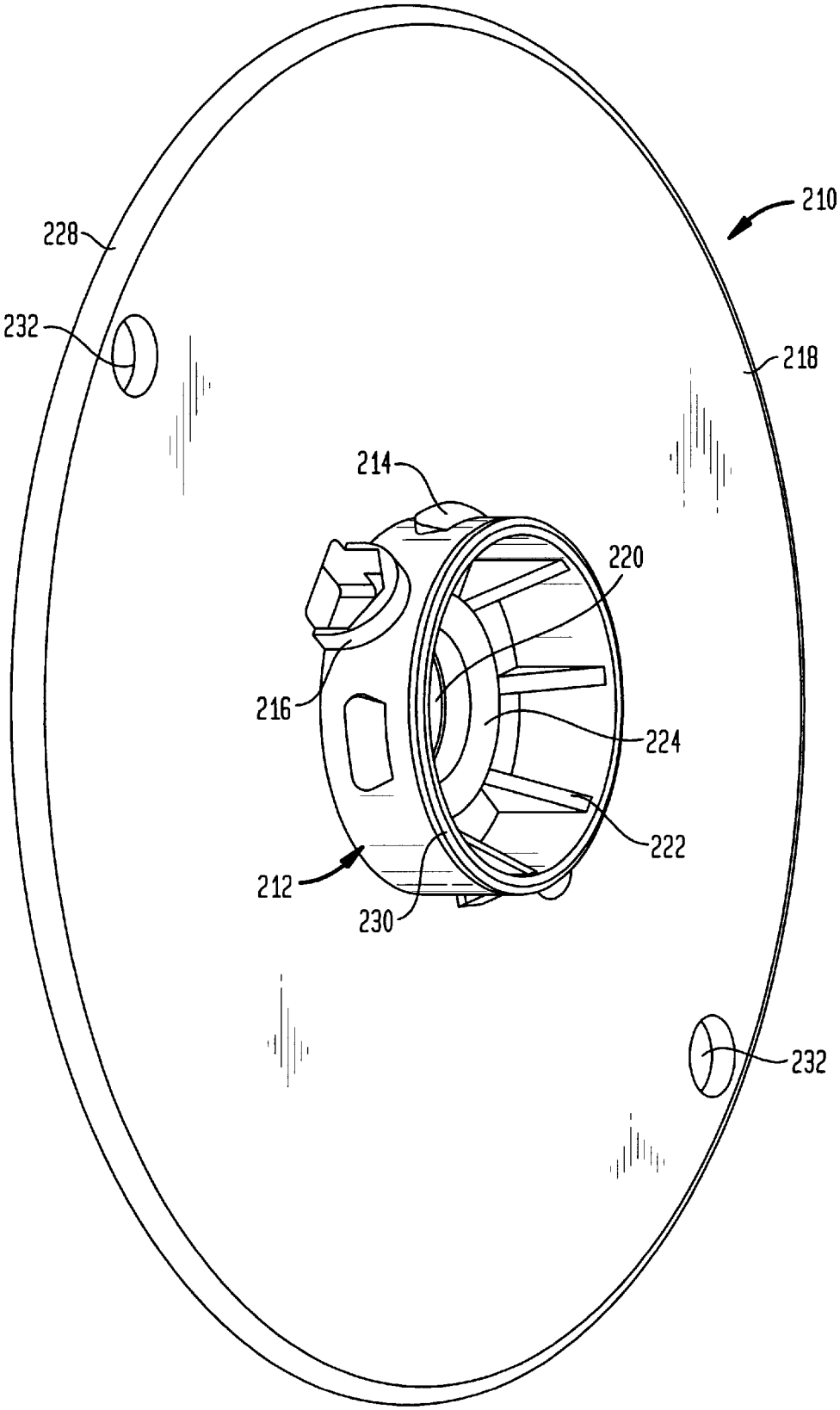
FIG. 5 is a perspective view of a flange of the spool of FIG. 1 from the side of the location of the hub.
Figure 6:
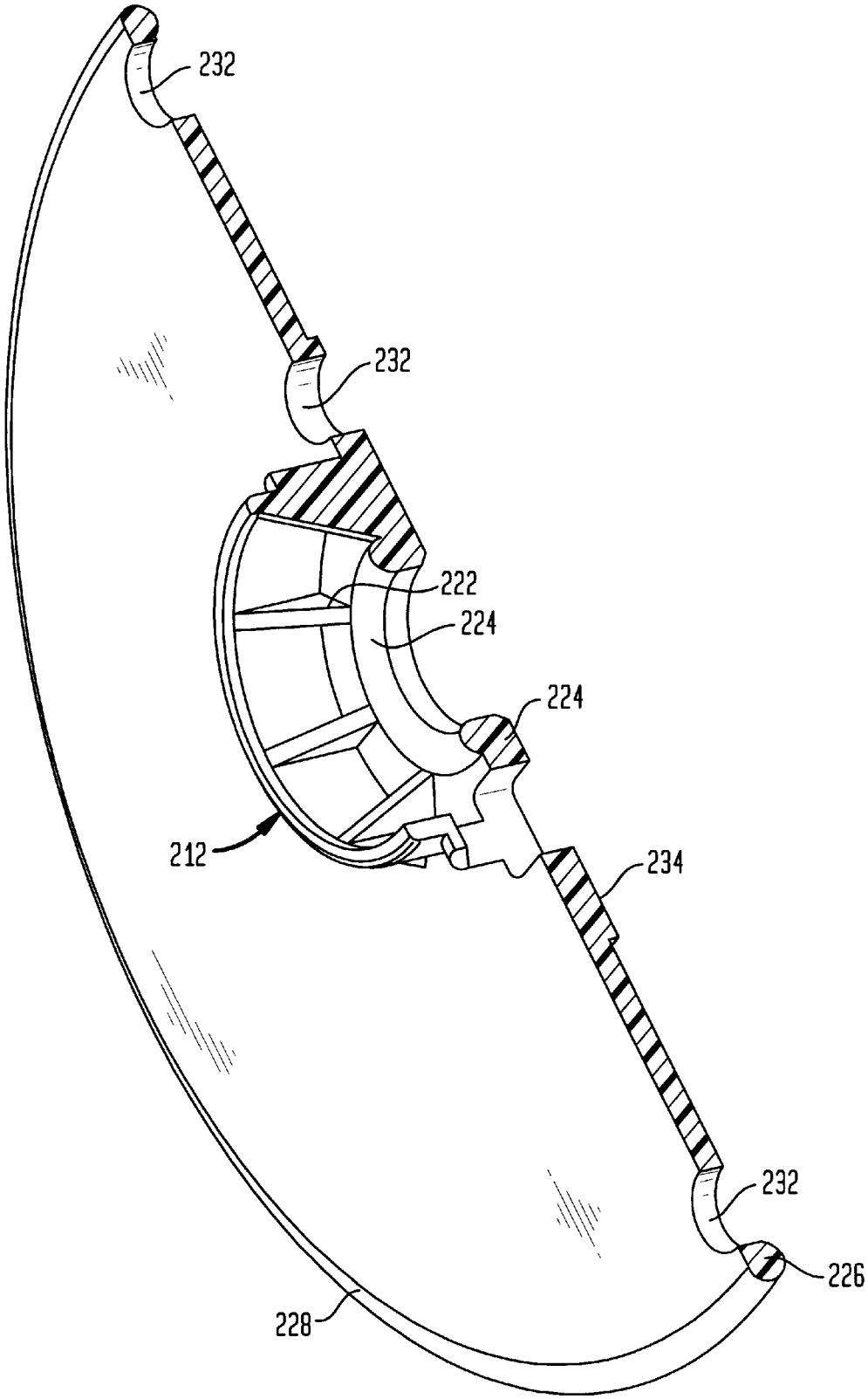
FIG. 6 is a perspective sectional view of a flange of the spool of FIG. 1 through a plane intersecting the axis of the flange and viewed from the side of the location of the hub.
Figure 7:
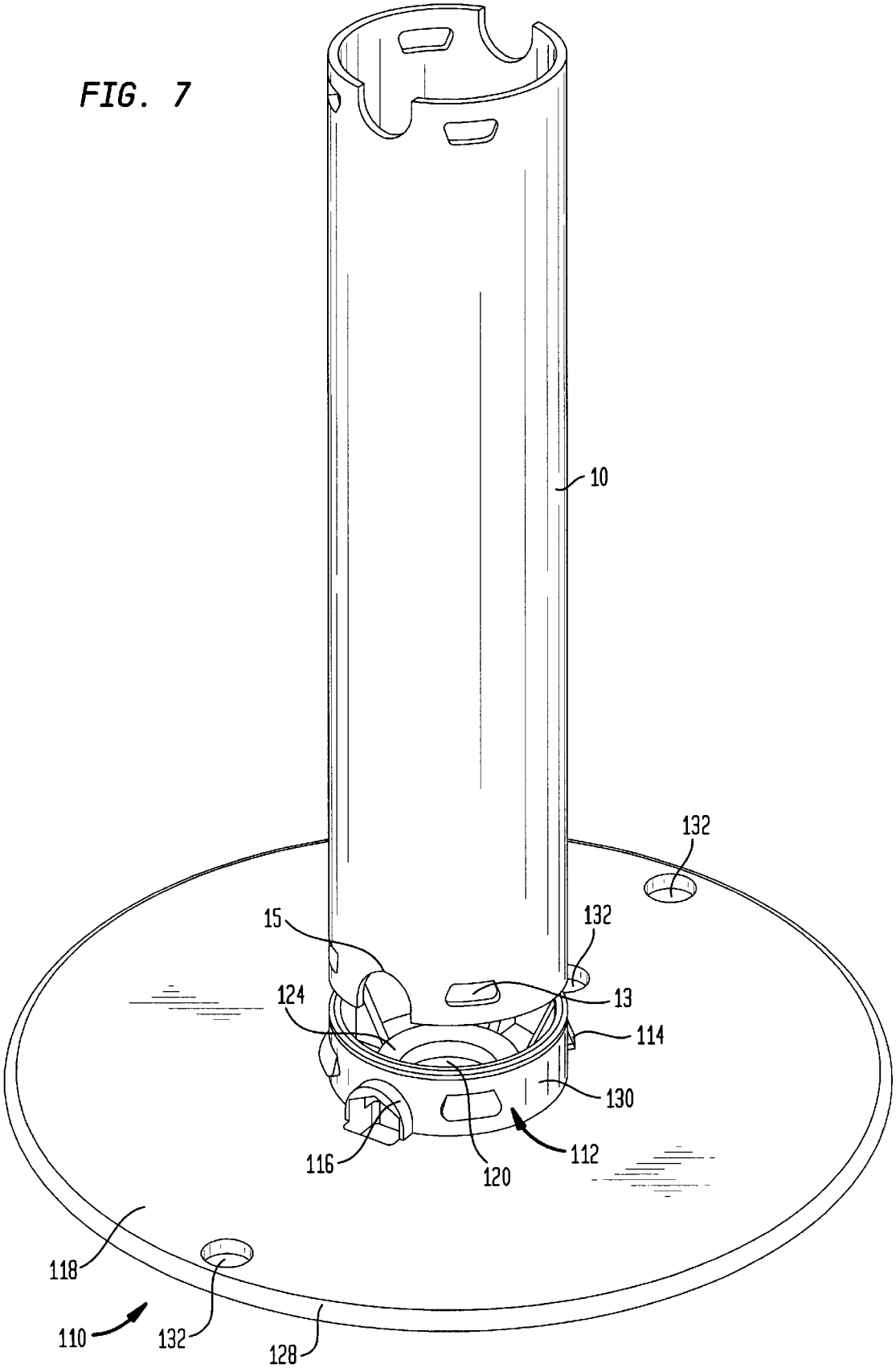
FIG. 7 is a perspective and exploded view of the spindle and of one flange of the spool.
Figure 8:
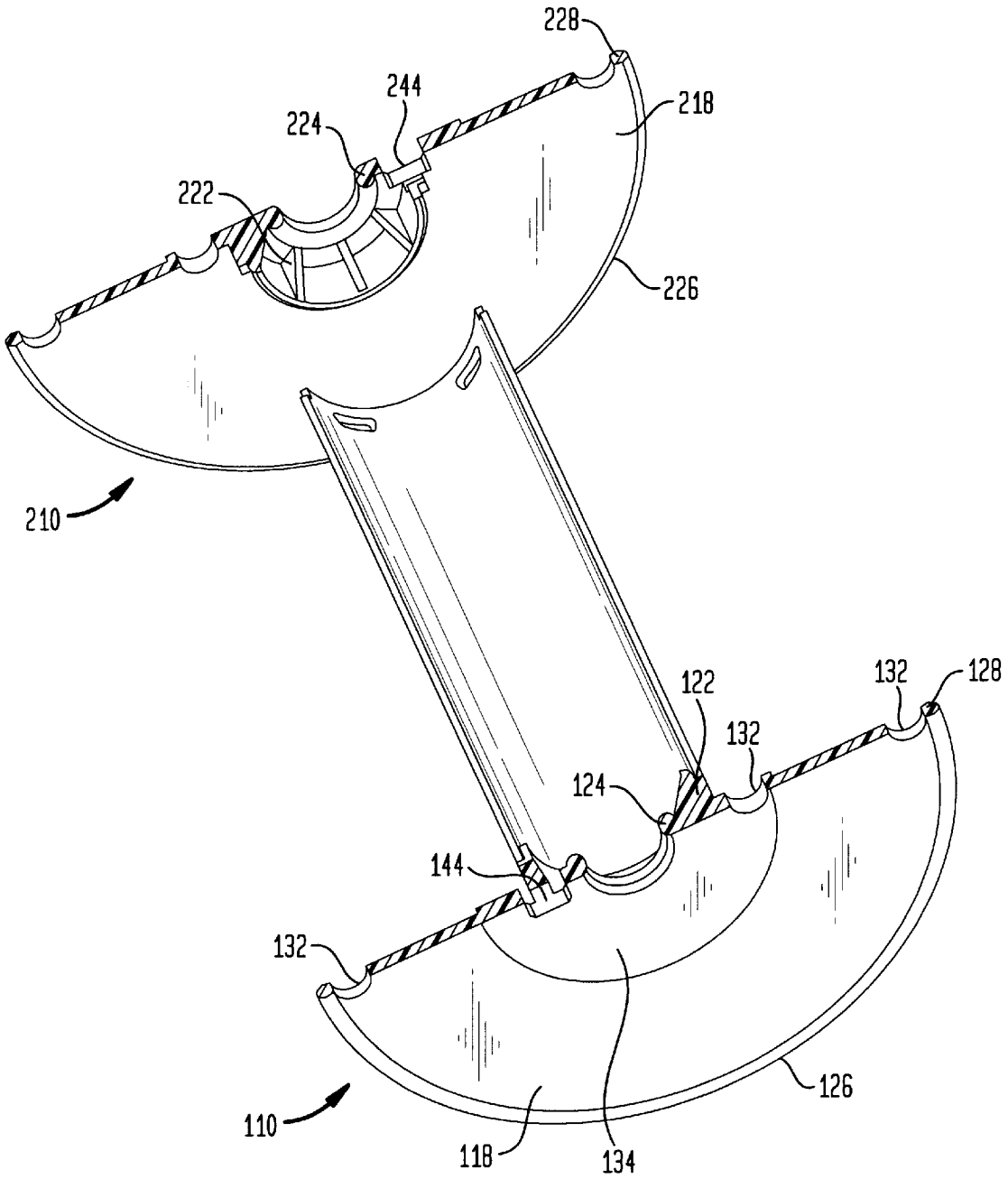
FIG. 8 is a perspective view in a section through a central axis of one flange attached to the spindle and of a second flange in engagement position with the spindle.

The spindle 10, shown in FIG. 2, can be formed from a standard piece of tubular stock. Each one of the two ends 11, 12 of the spindle 10 is furnished with a guiding notch 15, 16 and a locking opening 13, 14. The guiding notch 15, 16 serves to engage a corresponding guiding member 116, 216, on the corresponding flange 110, 210, as shown in FIGS. 1 and 7. The locking opening 13, 14 serves to solidly attach the spindle end 11, 12 to a respective hub 112, 212 of a flange 110, 210.

The guiding notch 15, 16 can be an opening in the end 11, 12 of a spindle 10, an outward indentation of the wall of the spindle 10, or a recess in the inner side of the wall of the spindle 10 at the spindle end 11, 12. The guiding notch 15, 16 can have a shape which is open at the end 11, 12 of the spindle 10 and which is shaped convexly rounded when seen in a direction toward the center of the spindle 10 or in other words, the guiding notch 15, 16 is concavely shaped at a bottom. The open width of the guiding notch 15, 16 at the end 11, 12 of the spindle 10 can be from about 0.1 to 0.3 times the diameter of the spindle 10, and is preferably from about 0.15 to 0.25 times the diameter of the spindle 10. The depth of the guiding notch 15, 16 can be from about 0.5 to 5 times the open width of the guiding notch 15, 16 at the end 11, 12 of the spindle 10, and preferably from about 0.8 to 1.2 times the open width of the guiding notch 15, 16 at the end 11, 12 of the spindle 10. The shape of the guiding notch 15, 16 should be such that the radius of curvature of the guiding notch 15, 16 is always over the periphery directed to the open inside area of the guiding notch 15, 16. Preferably, the shape of the guiding notch 15, 16 is a semi-circle, where the end tangents of the semicircle are extended in parallel lines. This allows for a simple construction and production of the guiding notches 15, 16, while at the same time a guide function is present.

There can be a plurality of guiding notches 15, 16. If there is a plurality of guiding notches 15, 16, then the hub 112, 212 of the flange 110, 210 should contain at least one outer guiding member 116, 216, and preferably a number of outer guiding members 116, 216, which correspond to at least one of the guiding notches 15, 16. Preferably, two guiding notches 15, 16 are provided. The guiding notches 15, 16 will be spaced at an angle of 180 degrees if it does not matter in which of the two possible positions the hub 112, 212 engages the spindle 10. If it is desired that the spindle 10 is mounted to the flange 110, 210 in a single defined position, then either one single guiding notch 15, 16 is provided or the guiding notches 15, 16 are distributed asymmetrically over the end 11, 12 of the spindle 10 such that they will fit to the guiding members 116, 216 of the hub 112, 212 of the flange 110, 210 in only a single position.

The guiding notch 15, 16 serves first to allow to slide the spindle 10 over the hub 112, 212 of the respective flange 110, 210 in a proper aligned position. The guiding notch 15, 16 serves further to counterbalance forces, which attempt to twist the spindle 10 relative to the respective flange 110, 210.

The locking opening 13, 14 is preferably of an elongated shape in rotation direction of the spindle 10. The locking opening 13, 14 could be a recess in the inner side of the wall of the spindle 10. Preferably, the locking opening 13, 14 represents a breakout opening in the wall of the spindle 10. It is then possible to observe from the outside if the flange 110, 210 and the spindle 10 engage lockingly at a certain breakout or locking opening 13, 14. The length of the locking opening 13, 14 in rotation direction is preferably 1.2 to 3 times the width of the opening 13, 14 in axial direction of the spindle 10, and is preferably from about 1.5 to 2.5 times the width of the locking opening 13, 14 in axial direction of the spindle 10. The locking edge of the locking opening 13, 14, disposed toward the respective end 11, 12 of the spindle 10, serves to counterbalance forces which attempt to disengage the respective flange 110, 210 from the spindle 10. This edge is preferably provided in a plane perpendicular to the spindle axis such that a slippage of the locking member 114, 214 will not occur when forces appear to disengage flange 110, 210 and spindle 10. A preferred shape of the locking opening 13, 14 is rectangular, where, however, the corners may be rounded based on manufacturing tolerances.

Figure 13:
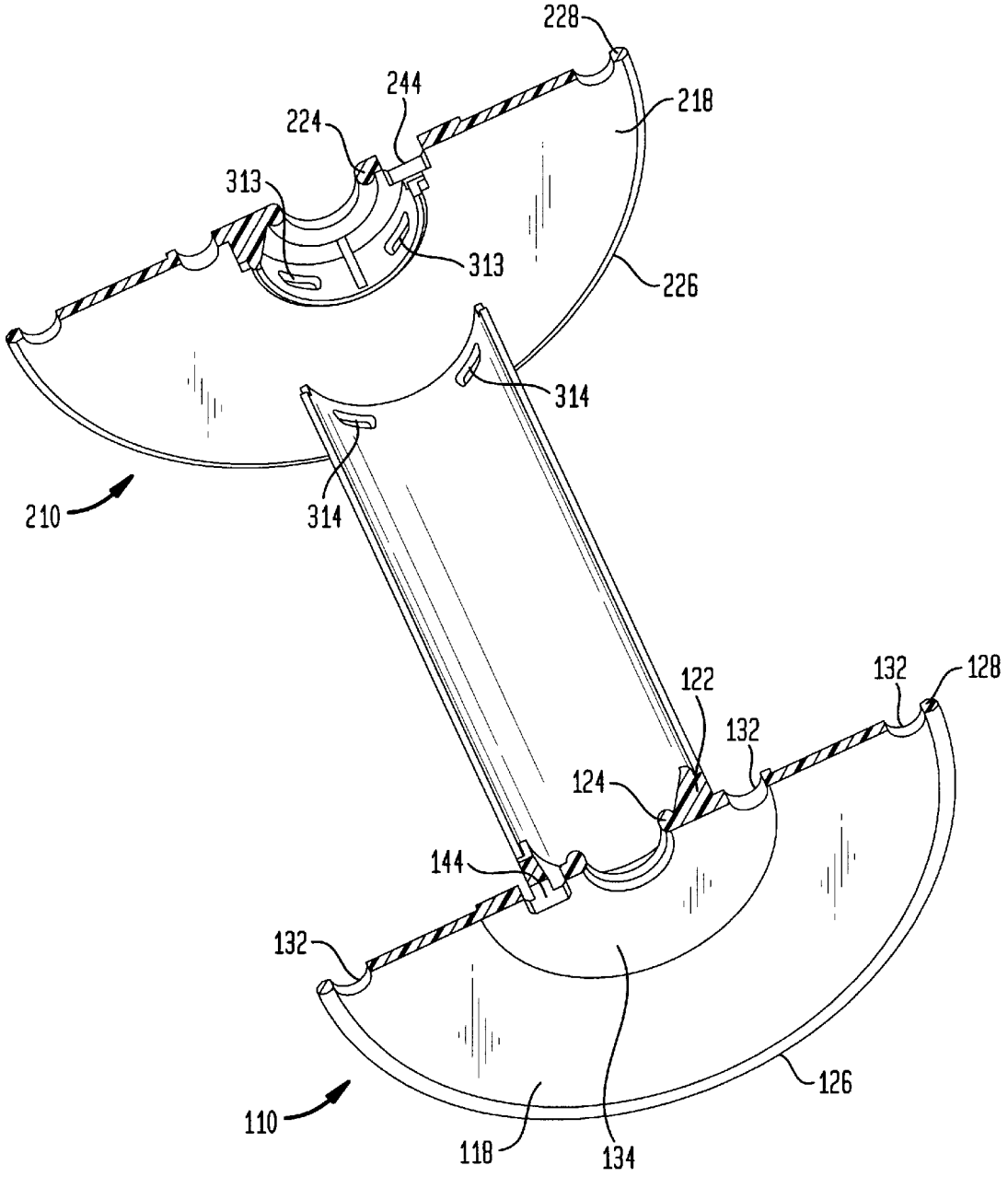
FIG. 13 shows a perspective view of a sixth embodiment of the flange, where the locking members are furnished as slots.

In principle, a single locking opening 13, 14 could be sufficient to provide attachment of the spindle 10 to the respective flange 110, 210. However, since the locking opening 13, 14 serves the counteract disengagement forces between spindle 10 and hub 112, 212 of the respective flange 110, 210, and since these forces can attack under any rotation angle of the spindle 10, it is preferred to provide a plurality of locking openings 13, 14 around the respective end 11, 12 of the spindle 10, for example 2, 3, 4, 6, 8 in a rotation symmetric fashion. Additionally, it is required that, both on the flange 110, 210 and on the spindle 10, the respective elements of locking opening 13, 14 and guiding notch 15, 16 match their respective counterpositions. This is most easily assured by providing a high rotation symmetry for both the locking openings 13, 14 and the guiding notches 15, 16. Thus, according to a preferred embodiment, all guiding notches 15, 16 and all locking openings 13, 14 have the same shape among themselves. The locking openings 13, 14 are aligned on a plane disposed perpendicular to the spindle axis. Two guiding notches 15, 16 are provided rotary spaced apart by 180 degrees. The locking openings 13, 14 show an even numbered rotational symmetry and additionally exhibit a mirror symmetry relative to a plane defined by two locking openings 13, 14. Thus, a preferred embodiment is shown in the drawing, where two guiding notches 15, 16 are spaced apart by 180 degrees, and where the four locking openings 13, 14 are spaced apart from each other by 90 degrees and at the same time are disposed at an angle of 45 or 135 degrees relative to the guiding notches 15, 16. Preferably, the configuration of the guiding notches 15, 16 and of the locking openings 13, 14 are of the same geometry on the two sides of the spindle 10. However, it is not necessary that the guiding notch 15 and locking openings 13 on the first end 11 of the spindle 10 have a certain position relative to the guiding notch 16 and locking openings 14 on the second end 12 of the spindle 10 since the flanges 110, 210 are generally mounted independently of each other to the spindle 10. FIG. 13 shows an embodiment, wherein the locking openings 313 are disposed at the hub and locking members 314 are disposed on the inner surface of the spindle 10.

The flange 110, 210 comprises in general substantially a rotary disk 118, 218 and a hub 112, 212 solidly and centeredly attached to the rotary disk 118, 218. The hub 112, 212 is preferably provided with a substantially cylindrical outer face 130, 230, where the cylindrical outer face 130, 230 is interrupted by locking members 114, 214 and by guiding members 116, 216. The locking members 114, 214 are constructed such that they fit into a corresponding locking opening 13, 14 of the spindle 10 and the guiding members 116, 216 are constructed such that they fit into a corresponding guiding notch 15, 16 in the spindle 10. Thus, the number and symmetry of the guiding members 116, 216 and of the locking members 114, 214 will correspond to the number and symmetry of the guiding notches 15, 16 and of the locking openings 13, 14 to be matched. It is to be noted, however, that the number of guiding members 116, 216 on the hub 112, 212 of the flange 110, 210 could in principle be smaller than the number of guiding notches 15, 16, and that the number of locking members 114, 214 could in principle be smaller than the number of locking openings 13, 14 on a corresponding end 11, 12 of the spindle 10. However, a more efficient connection is provided when there is a one to one correspondence between locking openings 13, 14 and locking members 114, 214 as well as between guiding notches 15, 16 and guiding members 116, 216.

The hub 112, 212 is preferably formed as a cylindrical tube section with the exception of the attached locking members 114, 214 and the attached guiding members 116, 216. The outer diameter of the tube section of the hub 112, 212 matches the inner diameter of the spindle 10 such that the spindle 10 can be easily and reliably slid with a respective end 11, 12 over the respective hub 112, 212.

The guiding members 116, 216 correspond in their shape preferably to the matching shape of the guiding notches 15, 16. The thickness of the guiding members 116, 216 is preferably from about 0.8 to 1.2 times the thickness of the tube of the spindle 10, and more preferably from about 0.9 to 1.1 times the thickness of the tube of the spindle 10 such that radial torsion forces which might occur can be easily balanced by the guiding member 116, 216 and the guiding notch 15, 16. It is not necessary that the guiding member 116, 216 has the same axial extension as the guiding notch 15, 16 and, in general, the axial length of the guiding notch 15, 16 will be larger, for example 1.2 to 1.5 times the axial length of the guiding member 116, 216.

The locking member 114, 214 has in general a periphery which corresponds closely to the periphery shown by the locking opening 13, 14. In principle, each locking member 114, 214 should have a shape matching the shape of the corresponding locking opening 13, 14. Since the spindle 10 is to be capable of being slid onto the hub 112, 212, the thickness of the locking member 114, 214 on the side toward the center of the spindle 10 is to approach zero so that the locking member 114, 214 does not present a barrier to the sliding on of the spindle 10 onto the hub 112, 212. The thickness of the locking member 114, 214 as seen in an axial direction of the hub 112, 212 increases then and the thickness reaches a maximum at the axial end of the locking member 114, 214 in a direction to the corresponding disk 118, 218 of the flange 110, 210. The increase in thickness of the locking member 114, 214 can be a substantially linear function relative to the axial direction of the hub 112, 212. The end wall of the locking members 114, 214 toward the disk 118, 218 follows substantially a plane perpendicular through the axis of the hub 112, 212. In contrast to the locking openings 13, 14, the locking members 114, 214 can be preferably of a symmetrically trapezoidal shape, where the edges of the locking members 114, 214 in a direction more or less parallel to the hub axis form an angle of from about 60 to 80 degrees relative to a plane perpendicular to the hub axis, such that the locking member 114, 214 is narrower in the area where it has a small thickness as compared to the area of maximum thickness. A presence of symmetry on all engaging surfaces is desired, but not a requirement. The trapezoidal angle relative to a parallel to the axis of the hub 112, 212 can be from about 10 to 30 degrees.

The guiding notch 15, 16 should match the guiding configuration of the guiding member 116, 216 in order to allow the guiding member 116, 216 to perform the guiding function primarily at any point in time during insertion of the hub 112, 212 into the spindle end 11, 12. This is provided in order to allow the guiding member 116, 216 and the guiding notch 15, 16 to perform the guiding function and not to have the locking members 114, 214 perform the guide function where they are constructed without leaving leeway in a direction of rotation when initially engaging a locking opening 13, 14. The maximum thickness of the locking member 114, 214 can be from about 0.7 to 1.1 times the wall thickness of the spindle tube, and is preferably from about 0.8 to 1.0 times the wall thickness of the spindle tube.

The disk 118, 218 is preferably furnished with a central borehole 120, 220 such that the assembled spool can be placed on a rod and be rotated on the rod. The central borehole 120, 220 can have a diameter which is from about 0.3 to 0.7 times the outer diameter of the hub 112, 212 and is preferably from about 0.4 to 0.6 times the outer diameter of the hub 112, 212. Additional holes 132, 232 can be provided in the disk 118, 218 to allow for securing the linear material wound about the spool, and possibly to allow inspection of the spool at certain radial distances. A drive pin hole 144, 244 for winding machines is provided in the disk 118, 218. Gussets 122, 222 are preferably provided between the inner wall part of the disk 118, 218 inside the hub 112, 212 and the inner wall of the hub 112, 212. Preferably, the gussets 122, 222 are furnished centered at the locations of the locking members 114, 214 and of the guiding members 116, 216. This will provide a maximum strength connection between the hub 112, 212 and the spindle 10 as the position of the guiding members 116, 216 and of the locking members 114, 214 are easier fixed with less use of material as compared to an absence of the gussets 122, 222. The gussets 122, 222, 322, 422 preferably form rectangular triangles and preferably have a side in axial direction which has a length of from about 0.8 to 0.95 of the axial length of the hub 112, 212 and have a side in a radial direction which has a length of from about 0.8 to 0.95 times 0.5 times the difference between the inner diameter of the hub 112, 212 and the diameter of the center hole of the disk 118, 218.

A reinforcing collar 124, 224 can be disposed on the inner side of the disk 118, 218 surrounding the center borehole 120, 220 for providing additional strength to the flange 110, 210 when rotating on a round bearing bar. At the same time, the reinforcing collar 124, 224 strengthens the positional stability of the gussets 122, 222. Preferably, the disk 118, 218 is further reinforced in the region of the hub 112, 212, for example, by being thicker in the region surrounding the hub 112, 212 as compared to an outer region of the disk 118, 218. Preferably, the reinforcement 134, 234 is furnished by having the disk 118, 218 thickened to the outside beginning with the center borehole 120, 220 of the disk 118, 218 and ending at a diameter from about 1.5 to 2 times the outer diameter of the hub 112, 212. The thickness reinforcement 134, 234 can be, for example, from about 0.2 to 0.5 times the thickness of the disk 118, 218 in an outer region of the disk 118, 218. Alternatively, it is possible that the disk thickness continuously decreases in a radial direction beginning at the center borehole 120, 220 and going toward the outside of the disk 118, 218. Preferably, the disk 118, 218 is furnished with an outer rim or bead 126, 226 which is present in particular on the outside of the disk such that the disk 118, 218 is not easily notched or deformed by external forces hitting the outer edge 128, 228 of the disk 118, 218. The inner side of the disk 118, 218 when going from the hub 112, 212 to the outer edge 128, 228 is preferably provided completely smooth and planar.

The thickness of the gussets 122, 222 can be from about 0.5 to 2 times the thickness of the wall of the hub 112, 212. The thickness of the wall of the spindle 10 can be from about 0.5 to 2.0 times the thickness of the wall of the hub 112, 212. The thickness of the disk 118, 218 can be from about 2 to 10 times the thickness of the wall of the hub 112, 212 and is preferably from about 2 to 3 times the thickness of the wall of the hub 112, 212. Preferably, the outer sides of the disk 118, 218 are manufactured smoothly and without rough edges to avoid injury during handling by a human and in order to avoid mechanical and cutting interaction with other mechanical structures encountered by the assembled spools.

The axial length of the hub 112, 212 can be from about 1.2 to 5 times the axial length of the guiding notches 15, 16. The position of the guiding members 116, 216 on the hub 112, 212 is such that the spindle end 11, 12 can completely cover the hub 112, 212 when inserted and reach to the inner wall of the disk 118, 218 of the flange 110, 210. The hub 112, 212 can be made with a slightly tapered outside wall or outer face 130, 230 such as to allow an easier insertion of the hub 112, 212 into the spindle 10. Alternatively, the spindle 10 could have a slight expansion of the inner radius when moving in axial direction to an end 11, 12 of the spindle 10 in an area where the hub 112, 212 would be engaged in order to facilitate insertion. Alternatively, both the spindle 10 could show said slight inner taper and the hub 112, 212 could show said slight outer taper. The size of the taper could be a total of from about 0.001 to 0.01 times the outer radius of the hub 112, 212 or, respectively, times the inner diameter of the spindle 10.

It is not necessary that the spindle 10 and the flanges 110, 210 be made of the same material, but making all parts of the same material may be convenient and may provide a better technical solution in many environments, for example, where corrosion is to be avoided. Preferred materials to be used are those which show sufficient strength and toughness to be capable to withstand the daily requirements of winding and unwinding of such spools as well as rough transport conditions for such spools. For example, such spools could be made of metal such as steel, copper, stainless, and aluminum alloys or of plastic such as polyethylene, polypropylene, polystyrene, injection moldable plastics, and, in particular, of those plastics which retain their configurational shape even under severe conditions.

According to a first embodiment, the attachment of the tube or spindle 10 to the flanges 110, 210 is facilitated by using "rigid snap undercuts" or locking members 114, 214, positioned about the outer circumference of the hub 112, 212 of the flange 110, 210. Said locking members 114, 214 exhibit self-locking face angles which engage corresponding slots or locking openings 13, 14 in the ends 11, 12 of the spindle 10. To facilitate deflection for assembly, the spindle 10 employs the cantilever beam theory by use of multiple radiused cutouts or guiding notches 15, 16 at the ends 11, 12 of the spindle 10, projecting inward parallel to the axis of insertion to a depth of no less than twice the height of deflection, where the radiused cutouts or guiding notches 15, 16 interrupt the circumference to create the beam. The flange hubs 112, 212 use radiused primary guide locator lugs or guiding members 116, 216 which mate with the cutouts or guiding notches 15, 16 in the spindle 10 and align the flange hub 112, 212 and spindle 10 for assembly, rest and restrict movement of the mating parts once assembled, and absorb and transmit the rotating torque and stresses, generated during the winding process, between the flange hub 112, 212 and the spindle 10, thereby not subjecting the rigid locking members 114, 214 to strain during winding.

The core tube or spindle 10 deflects over the solid locking members 114, 214 of the flange hub 110, 210, facilitating the snap-together attachment of the three components, comprised of a first flange 110, a spindle 10, and a second flange 210. The deflection of the spindle component 10 is facilitated by the guiding notch 15, 16 located in the spindle 10, which guiding notch 15, 16 acts as a cantilever beam. This combination of mechanics and the elastic properties of the spindle material and flange hub 112, 212 allow for the quick and easy manual assembly of the components without the use of any adhesives, tools or machinery, and without any deformation or compromise of the structural integrity of the plastic components.

According to a preferred embodiment, the attachment of the tube or spindle 10 to the flanges 110, 210 is facilitated by using deflecting locking members 114, 214, positioned about the outer circumference of the flange hub 110, 210, with self-locking face angles which engage corresponding locking openings 13, 14 in the spindle 10. The deflecting locking members 114, 214 employ the cantilever beam theory to facilitate deflection for assembly. The invention flange hubs 110, 210 use radiused primary guide locator lugs or guiding members 116, 216 which mate with corresponding guiding notches 15, 16 in the spindle 10 to align the flange hub 110, 210 and spindle 10 for assembly, nest and restrict movement of the mating parts once assembled, and absorb and transmit the rotating torque and stresses, generated during the winding process, between the flange hub 110, 210 and the spindle 10, thereby not subjecting the deflecting locking members 114, 214 to strain during winding.

Figure 9:
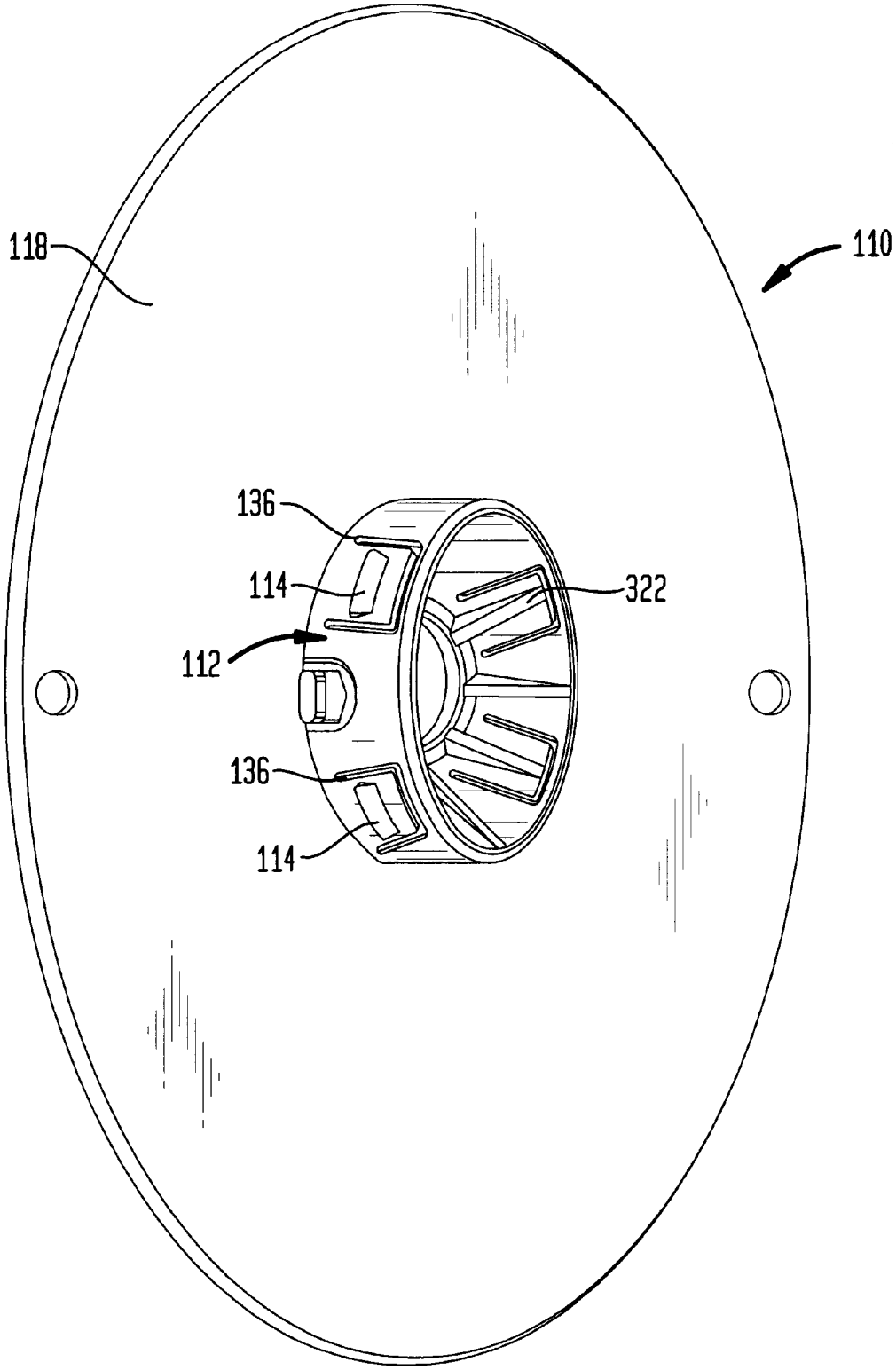
FIG. 9 is a perspective view of a second embodiment of the flange, where the locking members are surrounded by a first type of slot structure.
Figure 10:
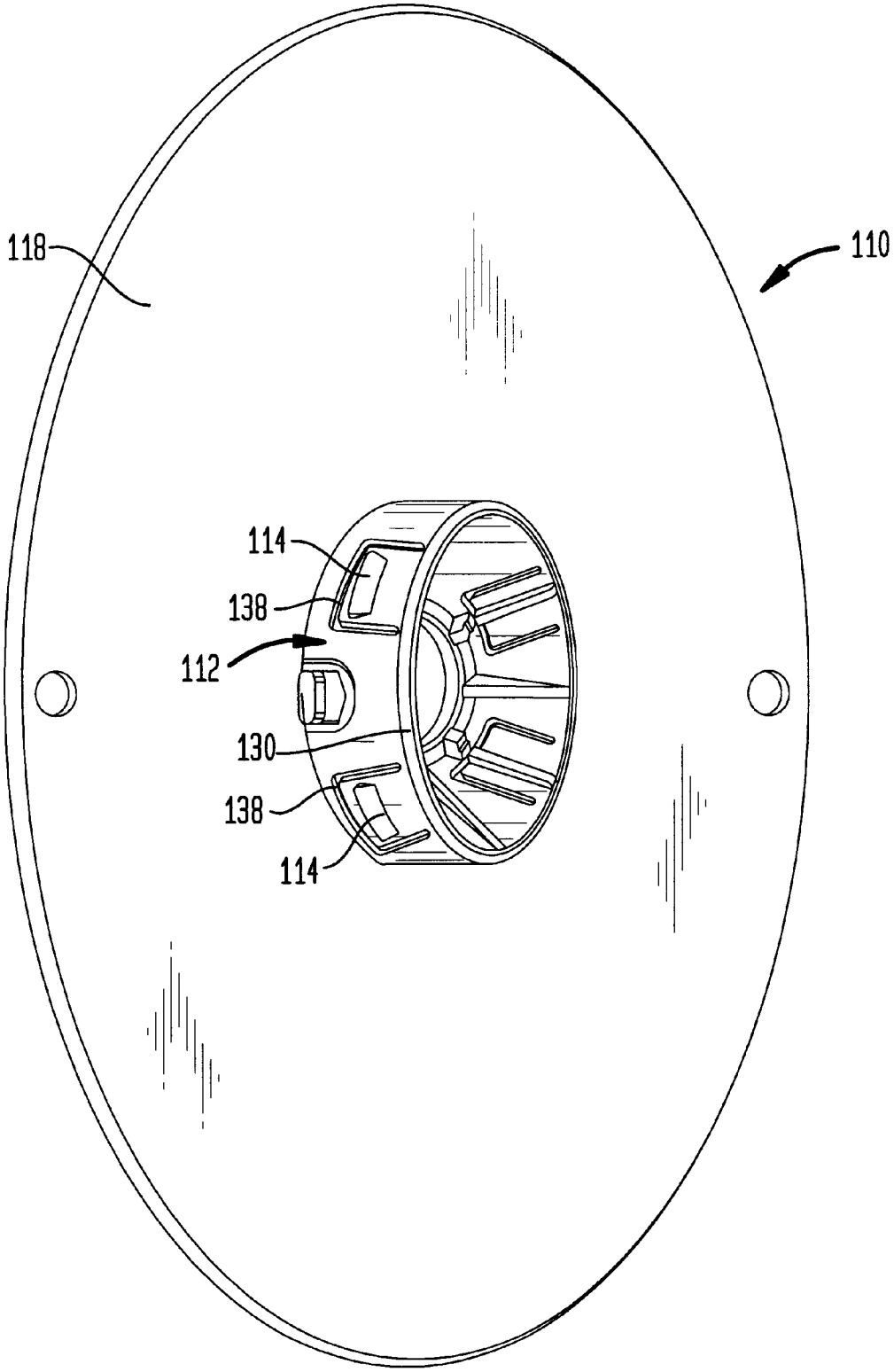
FIG. 10 is a perspective view of a third embodiment of the flange, where the locking members are surrounded by a second type of slot structure.

A slot 136, 138 as shown in FIGS. 9 and 10 surrounds the locking member 114, 214 on three sides to facilitate flexing the locking member 114, 214 and to relieve stress on the spindle 10 as it is slipped over the locking member 114, 214 on the hub 112, 212 of the flange 110, 210. A first variant of such a slot 136 is shown in FIG. 9 and exhibits a U shape, where the open end of the U shape faces toward the disk 118 of the first flange 110. A second variant of such a slot is shown in FIG. 10 with the reference numeral 138 and has a U shape, where the open end of the U shape faces toward the outer face 130 of the hub 112. The respective slots around the locking member 214 on the hub 212 of the second flange 210 are of identical shape relative to the slots 136 and 138, respectively.

Figure 11:
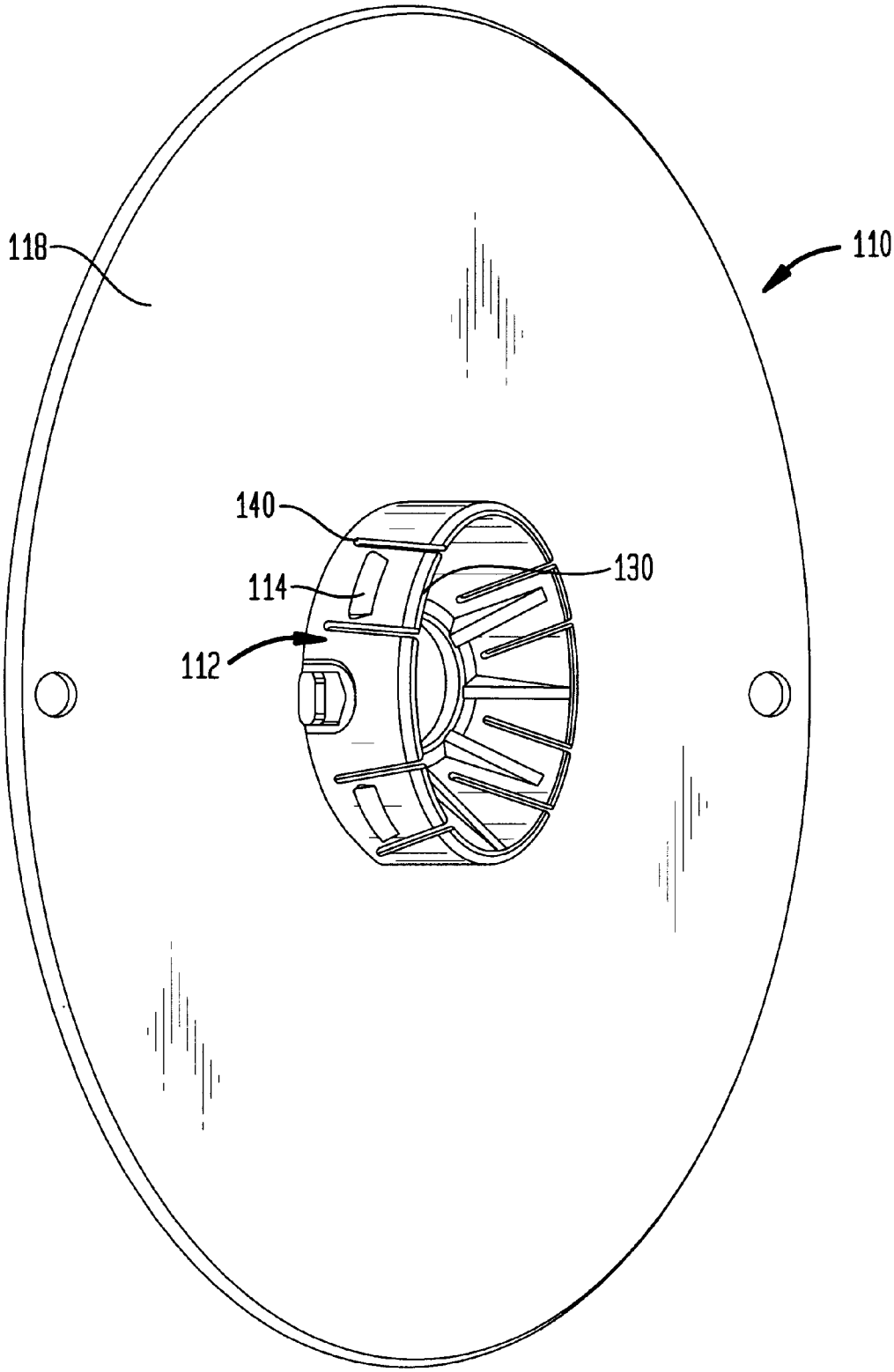
FIG. 11 is a perspective view of a fourth embodiment of the flange, where the locking members are surrounded by a third type of slot structure.

Alternatively, as shown in FIG. 11, a slot 140 is disposed on each of two sides of the locking member 114, 214 to facilitate flexing of the locking member 114, 214 and to relieve stress on the spindle 10 as it is slipped over the locking member 114, 214 on the hub 112, 212 of the flange 110, 210. The slot 140 runs parallel to the axis of the flange 110, 210 and extends to the outer face 130, 230 of the hub 112, 212 according to the embodiment of FIG. 11 and thereby forms a slot 140 having an open end.

Figure 12:
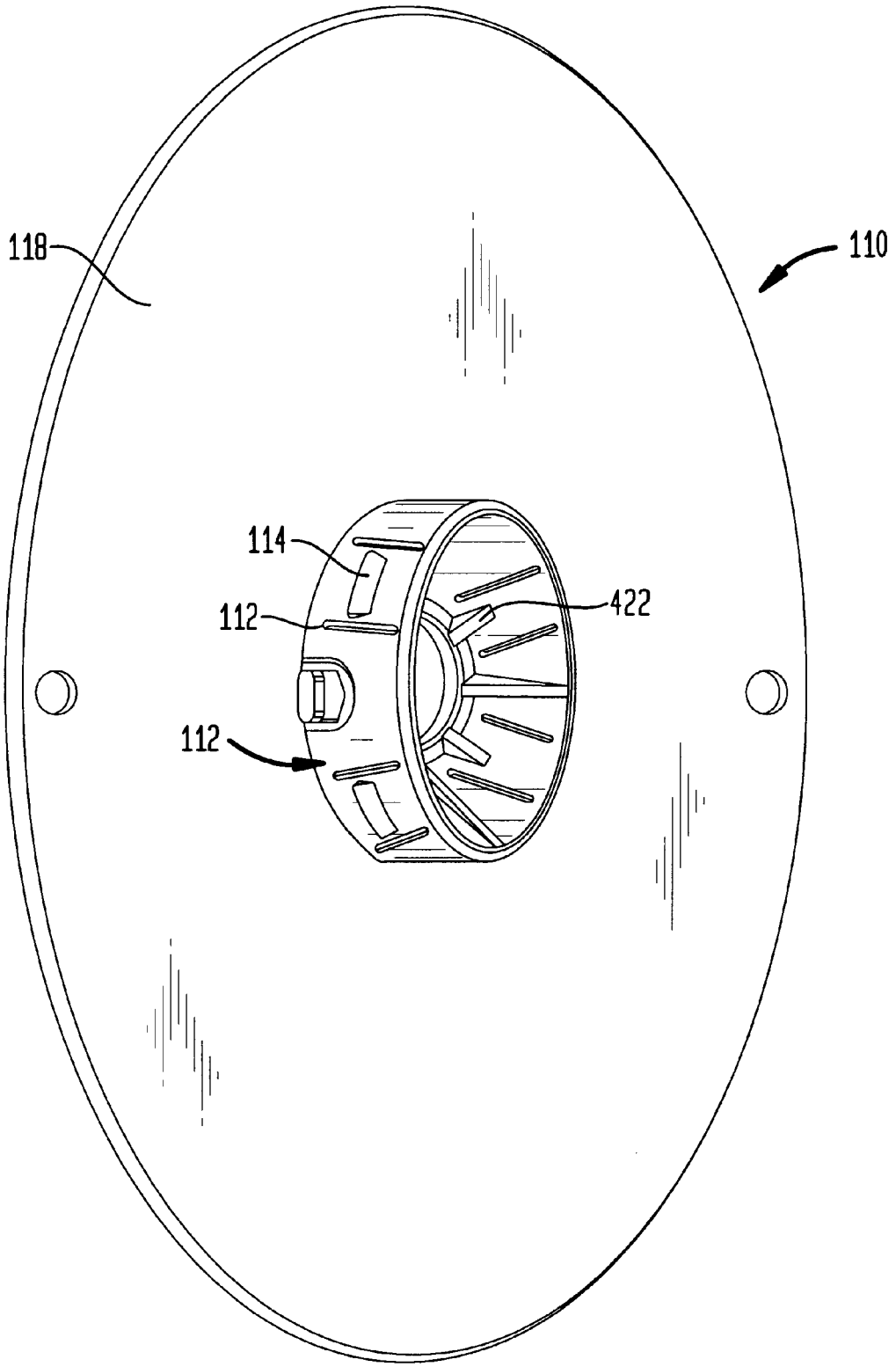
FIG. 12 is a perspective view of a fifth embodiment of the flange, where the locking members are surrounded by a fourth type of slot structure.

The embodiment of FIG. 12 resembles the embodiment of FIG. 11, however slot 142 is constructed to be completely contained within the hub 112 and not to have an open end.

The spindle 10 expands and the flexing locking members 114, 214 on the flange hub component 110, 210 deflect as the spindle 10 is being inserted over the flexing locking members 114, 214 on the flange hub 112, 212 facilitating the snap-together attachment of the three components, comprised of a first flange 110, a spindle 10, and a second flange 210. This combination of deflection of the spindle 10 and deflection of the locking members 114, 214 facilitates the use of a more rigid spindle material since the easy snap-together assembly of the three components does not rely entirely on the deflection of the spindle 10 or elastic properties of the material of the spindle 10 and of the flange 110, 210.

According to a fifth embodiment shown in FIG. 12, the attachment of the tube or spindle 10 to the flanges 110, 210 is facilitated using semi-rigid deflecting locking members 114, 214, positioned about the outer circumference of the flange hub 112, 212, with self-locking face angles which engage corresponding locking openings 13, 14 in the spindle 10. The semi-rigid deflecting locking members 114, 214 employ a combination of the cantilever beam and the torsional beam theory to facilitate deflection for assembly. The invention flange hubs 112, 212 use radiused primary guide locator lugs or guiding members 116, 216 which mate with corresponding guiding notches 15, 16 in the spindle 10 to align the flange hub 112, 212 and spindle 10 for assembly, nest and restrict movement of the mating parts once assembled, and absorb and transmit the rotating torque and stresses, generated during the winding process, between the flange hub 112, 212 and the spindle 10, thereby not subjecting the semi-rigid deflecting locking members 114, 214 to strain during winding.

The two guiding members 116, 216 on the flange hub 112, 212 align the assembly of the three components comprised of a first flange 110, a spindle 10, and a second flange 210. Additionally, the two guiding notches 15, 16 disposed on the ends 11, 12 of the spindle 10 absorb the rotating torque of the spool assembly during the process of winding material onto the spool assembly. Also, the use of two symmetrical guiding notches 15, 16 facilitates quicker assembly since the spindle 10 can be inserted over the flange hub 112, 212 in two positions.

It will be understood that each of the elements described above, or two or more together, may also find a useful application in other types of spools differing from the types described above.

While the invention has been illustrated and described as embodied in the context of a 3-piece spool assembly, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A spool assembly comprising a spindle formed as a tubular section having an inner surface and having a first end with a first end face and having a second end with a second end face;

a first guiding notch provided in the first end face of the spindle; a second guiding notch provided in the second end face of the spindle;

a first locking means furnished near the first end of the spindle;

a second locking means furnished near the second end of the spindle;

a first flange comprising a first disk, a first hub centeredly and fixedly attached to the first disk and having a tubular shape such that an outer face of the first hub matches the inner surface of the spindle, a first guiding projection disposed on said first hub for engaging the first guiding notch and for allowing the spindle to slide over the first hub in a proper aligned position, a first locking member on the first hub for engaging the first locking means such that upon insertion of the first hub into the first end of the spindle a connection between the first locking member and the first locking means is obtained which is stable against pulling forces in an axial direction, wherein the first guiding projection facilitates achieving a locking orientation of the first locking member and the first locking means by inducing a rotation of the first hub relative to the spindle upon said insertion of the first hub into the first end of the spindle until said first locking member and said first locking means are aligned;

a second flange comprising a second disk, a second hub centeredly and fixedly attached to the second disk and having a tubular shape such that an outer face of the second hub matches the inner surface of the spindle, a second guiding projection disposed on said second hub for engaging the second guiding notch and for allowing the spindle to slide over the second hub in a proper aligned position, a second locking member on the second hub for engaging the second locking means such that upon insertion of the second hub into the second end of the spindle a connection between the second locking member and the second locking means is obtained which is stable against the pulling forces in the axial direction, wherein the second guiding projection facilitates achieving a locking orientation of the second locking member and the second locking means by inducing a rotation of the second hub relative to the spindle upon said insertion of the second hub into the second end of the spindle until said second locking member and said second locking means are aligned.

2. The spool assembly according to claim 1, wherein the spindle is hollow.

3. The spool assembly according to claim 1, wherein a width of the first guiding notch is from about 0.1 to about 0.3 of the diameter of the spindle and a width of the second guiding notch is from about 0.1 to about 0.3 of the diameter of the spindle; and wherein a depth of the first guiding notch is from about 0.5 to about 5 times the width of one of the first guiding notch and the second guiding notch and a depth of the second guiding notch is from about 0.5 to about 5 times the width of one of the first guiding notch and the second guiding notch.

4. The spool assembly according to claim 1, wherein the first locking means has a substantially rectangular shape; and wherein the second locking means has said substantially rectangular shape;

wherein a width of the first guiding notch is from about 0.1 to about 0.3 of the diameter of the spindle and wherein a width of the second guiding notch is from about 0.1 to about 0.3 of the diameter of the spindle;

wherein a depth of the first guiding notch is from about 0.5 to about 5 times the width of the first guiding notch and wherein a depth of the second guiding notch is from about 0.5 to about 5 times the width of the second guiding notch.

5. The spool assembly according to claim 1, wherein a shape of the first guiding projection substantially matches a shape of the first guiding notch; and wherein a shape of the second guiding projection substantially matches a shape of the second guiding notch.

6. A spool assembly according to claim 1, wherein said first guiding projection is shaped to align said first locking member and said first locking means, and said second guiding projection is shaped to align said second locking member and said second locking means.

7. The spool assembly according to claim 1, further comprising a first central borehole in the first flange; and a second central borehole in the second flange.

8. The spool assembly according to claim 7, further comprising a first reinforcement collar surrounding the first central borehole for strengthening the first flange; and a second reinforcement collar surrounding the second central borehole for strengthening the second flange.

9. The spool assembly according to claim 1, wherein the first locking means is a first protrusion on the inner surface of the spindle near the first end of the spindle, wherein the second locking means is a second protrusion on the inner surface of the spindle near the second end of the spindle, wherein the first locking member is an opening in the first hub for engaging the first projection; and wherein the second locking member is an opening in the second hub for engaging the second projection.

10. The spool assembly according to claim 1, wherein the first locking means is a first locking opening furnished near the first end of the spindle;

wherein the second locking means is a second locking opening furnished near the second end of the spindle;

wherein the first locking member protrudes outwardly from the first hub for engaging the first locking opening;

wherein the second locking member protrudes outwardly from the second hub for engaging the second locking opening.

11. The spool assembly according in claim 10, wherein the first locking member has a generally right triangular shape in cross-section and wherein the second locking member has said generally right triangular shape in cross-section.

12. The spool assembly according to claim 1, wherein the first locking means is furnished as a first protrusion on the inner surface of the spindle near the first end of the spindle;

wherein the second locking means is furnished as a second protrusion on the inner surface of the spindle near the second end of the spindle;

wherein the first locking member is an opening in the first hub for engaging the first protrusion; and wherein the second locking member is an opening in the second hub for engaging the second protrusion.

13. The spool assembly according to claim 1, wherein the first locking means is a first locking recess furnished in the inner surface of the spindle and located near the first end of the spindle;

wherein the second locking means is a second locking recess furnished in the inner surface of the spindle and located near the second end of the spindle;

wherein the first locking member protrudes outwards from the first hub for engaging the first locking recess;

wherein the second locking member protrudes outwards from the second hub for engaging the second locking recess.

14. The spool assembly according to claim 1, wherein a first inner disk area of the first disk is more than 10 percent thicker as compared to a thickness of a first outer ring of the first disk;

wherein a second inner disk area of the second disk is more than 10 percent thicker as compared to a thickness of a second outer ring of the second disk;

wherein a periphery of the first flange is furnished with a first reinforcing rim; and wherein a periphery of the second flange is furnished with a second reinforcing rim.

15. The spool assembly according to claim 1, further comprising a first drive pin hole made in the first disk; and a second drive pin hole made in the second disk, wherein the first drive pin hole and the second drive pin hole are for engaging a winding machine.

16. A spool assembly comprising a spindle formed as a tubular section having an inner surface and having a first end with a first end face and having a second end with a second end face;

a first guiding notch provided in the first end face of the spindle;

a second guiding notch provided in the second end face of the spindle;

a first locking means furnished near the first end of the spindle;

a second locking means furnished near the second end of the spindle;

a first flange comprising a first disk, a first hub centeredly and fixedly attached to the first disk and having a tubular shape such that an outer face of the first hub matches the inner surface of the spindle, a first guiding member protruding outwardly from the first hub for engaging the first guiding notch to steer the spindle relative to the first hub into an aligned position upon insertion of the first hub into the first end of the spindle and for allowing the spindle to slide over the first hub in said aligned position, a first locking member on the first hub for engaging the first locking means such that upon said insertion of the first hub into the first end of the spindle a connection between the first locking member and the first locking means is obtained which is stable against pulling forces in an axial direction;

a second flange comprising a second disk, a second hub centeredly and fixedly attached to the second disk and having a tubular shape such that an outer face of the second hub matches the inner surface of the spindle, a second guiding member protruding outwardly from the second hub for engaging the second guiding notch to steer the spindle relative to the second hub into an aligned position upon insertion of the second hub into the second end of the spindle and for allowing the spindle to slide over the second hub in said aligned position, a second locking member on the second hub for engaging the second locking means such that upon said insertion of the second hub into the second end of the spindle a connection between the second locking member and the second locking means is obtained which is stable against the pulling forces in said axial direction, wherein the first guiding notch is recessed into a wall of the spindle and formed as an open slot having a concavely rounded surface at a bottom of the first guiding notch; and wherein the second guiding notch is recessed into the wall of the spindle and formed as an open slot having a concavely rounded surface at a bottom of the second guiding notch.

17. A spool assembly according to claim 16, wherein said first guiding member is shaped to align said first locking member and said first locking means, and said second guiding member is shaped to align said second locking member and said second locking means.

18. A spool assembly comprising a spindle formed as a tubular section having an inner surface and having a first end with a first end face and having a second end with a second end face;

a first guiding notch provided in the first end face of the spindle;

a second guiding notch provided in the second end face of the spindle;

a first locking means furnished near the first end of the spindle;

a second locking means furnished near the second end of the spindle;

a first flange comprising a first disk, a first hub centeredly and fixedly attached to the first disk and having a tubular shape such that an outer face of the first hub matches the inner surface of the spindle, a first guiding projection on the first hub for engaging the first guiding notch and for allowing the spindle to slide over the first hub in a proper aligned position, a first locking member on the first hub for engaging the first locking means such that upon insertion of the first hub into the first end of the spindle a connection between the first locking member and the first locking means is obtained which is stable against pulling forces in an axial direction, wherein the first guiding projection induces a relative rotation of the first hub and the spindle upon said insertion of the first hub into the first end of the spindle to align said first locking member and said first locking means;

a second flange comprising;

a second disk, a second hub centeredly and fixedly attached to the second disk and having a tubular shape such that an outer face of the second hub matches the inner surface of the spindle, a second guiding projection on the second hub for engaging the second guiding notch and for allowing the spindle to slide over the second hub in a proper aligned position, a second locking member on the second hub for engaging the second locking means such that upon insertion of the second hub into the second end of the spindle a connection between the second locking member and the second locking means is obtained which is stable against the pulling forces in the axial direction, wherein the second guiding projection induces a relative rotation of the second hub and the spindle upon said insertion of the second hub into the second end of the spindle to align said second locking member and said second locking means.

19. A spool assembly according to claim 18, wherein said first guiding projection is shaped to align said first locking member and said first locking means, and said second guiding projection is shaped to align said second locking member and said second locking means.

20. A spool assembly comprising a spindle formed as a tubular section having an inner surface and having a first end with a first end face and having a second end with a second end face;

a first guiding notch provided in the first end face of the spindle;

a second guiding notch provided in the second end face of the spindle;

a first locking means furnished near the first end of the spindle;

a second locking means furnished near the second end of the spindle;

a first flange comprising a first disk, a first hub centeredly and fixedly attached to the first disk and having a tubular shape such that an outer face of the first hub matches the inner surface of the spindle, a first guiding projection on the first hub for engaging the first guiding notch and for allowing the spindle to slide over the first hub in a proper aligned position, a first locking member on the first hub for engaging the first locking means such that upon insertion of the first hub into the first end of the spindle a connection between the first locking member and the first locking means is obtained which is stable against pulling forces in an axial direction, wherein the first guiding projection facilitates steering the first locking member and the first locking means into a locking position by inducing a rotation of the first hub relative to the spindle upon said insertion of said first hub into the first end of the spindle until said first locking member and first locking means are aligned;

a second flange comprising a second disk, a second hub centeredly and fixedly attached to the second disk and having a tubular shape such that an outer face of the second hub matches the inner surface of the spindle, a second guiding projection on the second hub for engaging the second guiding notch and for allowing the spindle to slide over the second hub in a proper aligned position, a second locking member on the second hub for engaging the second locking means such that upon insertion of the second hub into the second end of the spindle a connection between the second locking member and the second locking means is obtained which is stable against the pulling forces in the axial direction, wherein the second guiding projection facilitates steering the second locking member and the second locking means into a locking position by inducing a rotation of the second hub relative to the spindle upon said insertion of the second hub into the second end of the spindle until said second locking member and said second locking means are aligned.

21. A spool assembly according to claim 20, wherein said first guiding projection is shaped to align said first locking member and said first locking means, and said second guiding projection is shaped to align said second locking member and said second locking means.

* * * * *

UNITED STATES PATENT AND TRADEMARK OFFICE

CERTIFICATE OF CORRECTION

PATENT NO. : 6,045,087

DATED : April 4, 2000

INVENTOR(S) : Vislocky et al.

It is certified that error appears in the above-identified patent and that said Letters Patent is hereby corrected as shown below:

Title Page, item [54], line 4, delete "SPINDLE".

Col. 1, line 4, delete "SPINDLE".

Signed and Sealed this

Third Day of April, 2001

*Attest:*

Nicholas P. Godici

NICHOLAS P. GODICI

*Attesting Officer*

*Acting Director of the United States Patent and Trademark Office*